US008920193B2

(12) United States Patent
Riggsby et al.

(10) Patent No.: US 8,920,193 B2
(45) Date of Patent: Dec. 30, 2014

(54) PRECONNECTORIZED COAXIAL CABLE CONNECTOR APPARATUS

(75) Inventors: Robert R. Riggsby, Hickory, NC (US); John C. Chamberlain, Hickory, NC (US); Shi Man Li, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 332 days.

(21) Appl. No.: 13/325,509

(22) Filed: Dec. 14, 2011

(65) Prior Publication Data

US 2013/0157507 A1 Jun. 20, 2013

(51) Int. Cl.
*H01R 9/05* (2006.01)

(52) U.S. Cl.
USPC ..... 439/583; 439/578

(58) Field of Classification Search
CPC .. H01R 2103/00; H01R 13/622; H01R 24/40; H01R 9/0524; H01R 9/05
USPC ..... 439/578, 589, 583
See application file for complete search history.

(56) References Cited

U.S. PATENT DOCUMENTS

| | | | | |
|---|---|---|---|---|
| 3,641,464 | A * | 2/1972 | Crowhurst et al. | 333/112 |
| 4,226,495 | A * | 10/1980 | Palle et al. | 439/535 |
| 5,675,300 | A * | 10/1997 | Romerein | 333/100 |
| 5,735,711 | A * | 4/1998 | Fremgen | 439/578 |
| 6,648,683 | B2 * | 11/2003 | Youtsey | 439/578 |
| 6,929,508 | B1 | 8/2005 | Holland | |
| D532,385 | S * | 11/2006 | Shapson | D14/125 |
| 7,153,160 | B2 | 12/2006 | Montena | |
| 7,278,887 | B1 | 10/2007 | Palinkas et al. | |
| 7,300,309 | B2 * | 11/2007 | Montena | 439/578 |
| 7,347,728 | B2 | 3/2008 | Montena | |
| 7,404,738 | B2 | 7/2008 | Montena | |
| 7,513,795 | B1 | 4/2009 | Shaw | |
| 7,731,529 | B1 * | 6/2010 | Islam | 439/583 |
| 7,740,502 | B2 * | 6/2010 | Blew et al. | 439/578 |
| 7,830,225 | B2 * | 11/2010 | Gale | 333/131 |
| 2002/0164900 | A1 | 11/2002 | Youtsey | |
| 2005/0020128 | A1 | 1/2005 | Montena | |
| 2005/0085125 | A1 | 4/2005 | Montena | |
| 2006/0014427 | A1 * | 1/2006 | Islam et al. | 439/578 |
| 2008/0014790 | A1 | 1/2008 | Montena | |
| 2011/0312199 | A1 * | 12/2011 | Alrutz et al. | 439/578 |

OTHER PUBLICATIONS

*Thomas & Betts* Catalog—SNAP-N-Seal®; LRC®; STUBBY™—Data Sheets; 28 pages; 2007.

(Continued)

*Primary Examiner* — Briggitte R Hammond
(74) *Attorney, Agent, or Firm* — Myers Bigel Sibley & Sajovec

(57) ABSTRACT

A preconnectorized apparatus includes a housing and at least one F-style coaxial cable connector extending therefrom. Each connector has a connector body with a cable receiving end and an opposite forward end. A compression element coupled to the receiving end is movable between an unseated position and a seated position and is configured to secure a coaxial cable within the connector body when in the seated position. The connector includes a tubular inner contact post having a free end configured to be inserted into a prepared coaxial cable end. A receiving member positioned forward of the contact post is electrically connected to a circuit within the housing. The receiving member receives a center conductor of a coaxial cable inserted through the connector body cable receiving end and electrically connects the center conductor to the circuit.

13 Claims, 12 Drawing Sheets

(56) References Cited

OTHER PUBLICATIONS

Notification of Transmittal of the International Search Report and the Written Opinion of the International Searching Authority, or the Declaration and the Written Opinion of the International Searching Authority, corresponding to International Application No. PCT/US2012/060344; Date of Mailing: Mar. 29, 2013; 15 pages.

* cited by examiner

PRECONNECTORIZED COAXIAL CABLE CONNECTOR APPARATUS

FIELD OF THE INVENTION

The present invention relates to communications connectors and, more particularly, to connectors for coaxial cables.

BACKGROUND

A coaxial cable is a known type of electrical cable that may be used to carry radio frequency ("RF") signals. Coaxial cables are widely used as transmission lines in cable television networks and/or to provide broadband Internet connectivity. Coaxial cables are also used in a wide variety of other applications such as, for example, interconnecting electrical equipment, connecting electrical equipment to antennas and the like. FIG. 1 is a perspective view of a conventional coaxial cable 10 that has been partially cut apart to reveal its internal structure. As shown in FIG. 1, the coaxial cable 10 has a central conductor 12 that is surrounded by a dielectric insulator 14. A tape 16 may be bonded to the outside surface of the dielectric insulator 14. A metallic electrical shield 18 such as braided shielding wires surrounds the central conductor 12, dielectric insulator 14 and tape 16. One or more electrical shielding tapes (not shown in FIG. 1) may surround the metallic electrical shield 18. The central conductor 12, dielectric insulator 14, tape 16, electrical shield 18 and any electrical shielding tape are enclosed within a protective cable jacket 20.

The central conductor 12 of coaxial cable 10 may comprise, for example, a copper wire or a copper clad aluminum or steel wire. The central conductor 12 is designed to carry RF signals. Typically, a conductor such as central conductor 12 that carries RF or other high frequency signals acts as an antenna, and thus some of the signal energy is radiated from the conductor, resulting in signal loss or "attenuation." Coaxial cables are designed to reduce such signal attenuation by placing the electrical shield 18 (which is connected to a ground reference) around the central conductor 12. As a result of this arrangement, the electromagnetic field of the RF signal that is carried by the central conductor 12 is generally trapped in the space inside the electrical shield 18, thereby greatly reducing signal radiation and associated signal attenuation losses.

Typically, each end of a coaxial cable is terminated with a male coaxial connector. The most common type of coaxial connectors are referred to in the art as "F-style" coaxial connectors. Female F-style coaxial connectors, which are often referred to as "connector ports" are commonly mounted on wall plates in homes and on various devices such as televisions, cable modems, splitters, signal amplifiers, tap units, ground blocks, etc. A typical female F-style connector port comprises an externally threaded cylindrical housing that includes an aperture on one end thereof that is configured to receive a protruding central conductor of a male F-style coaxial connector. A typical male F-style coaxial connector includes an internally-threaded nut which is threaded onto the externally-threaded housing of the female F-style coaxial connector port. A coaxial cable that includes a coaxial connector on at least one end thereof is referred to herein as a "terminated coaxial cable." Terminated coaxial cables are used in a wide variety of applications including use as jumper cables, internal cabling within buildings, drop cables and the like.

FIG. 2 is a perspective view of a conventional male F-style coaxial connector 30. FIG. 3 is a side cross-sectional view of the male F-style coaxial connector 30 of FIG. 2. FIG. 4 illustrates the connector 30 of FIGS. 2-3 after it has been attached to an end of a coaxial cable 10 to produce a terminated coaxial cable.

As shown in FIGS. 2-4, the F-style coaxial connector 30 includes a body assembly 32, a compression sleeve 36 and an internally-threaded nut 38. The body assembly 32 includes a tubular connector body 33 and a contact post 34 (FIG. 3). In FIG. 2, the compression sleeve 36 is depicted in its "unseated" position in which it may receive a coaxial cable 10 that is to be terminated into the coaxial connector 30.

When the compression sleeve 36 of coaxial connector 30 is in its unseated position of FIG. 2, a coaxial cable such as cable 10 may be inserted axially into the compression sleeve 36 and the body assembly 32. The central conductor 12, dielectric insulator 14 and tape 16 of cable 10 (coaxial cable 10 is not depicted in FIGS. 2-3 to more clearly show the structure of the connector 30) are inserted axially into the inside diameter of the contact post 34, while the electrical shield 18, and the cable jacket 20 are inserted inside the tubular connector body 33 so as to circumferentially surround the outer surface of the contact post 34. The outside surface of the contact post 34 may include one or more serrations, teeth, lips or other retention structures 35 (see FIG. 3). Once the coaxial cable 10 is inserted into the coaxial connector 30 as described above, a compression tool may be used to forcibly axially insert the compression sleeve 36 further into the tubular connector body 33 into its "seated" position (see FIG. 4). Moving the compression sleeve 36 into its seated position decreases the radial gap between the tubular connector body 33 and the contact post 34 so as to radially impart a generally 360-degree circumferential compression force on the electrical shield 18 and the cable jacket 20 that circumferentially surround the outer surface of contact post 34. This compression, in conjunction with the retention structures 35 on the outside surface of the contact post 34, applies a retention force to the coaxial cable 10 that firmly holds the coaxial cable 10 within the coaxial connector 30. As shown in FIG. 4, the central conductor 12 of the coaxial cable 10 extends into the internal cavity of the internally-threaded nut 38 to serve as the male protrusion of the coaxial connector 30.

As noted above, male F-style coaxial connectors are used to mechanically and electrically attach a coaxial cable such as coaxial cable 10 to a female connector port. Connector boxes adapted to have a coaxial antenna lead-in cable as well as the coaxial or other type of cables for several receivers interconnected therewithin are already known and are conventionally referred to as "splitters" or "splitter boxes". Within such splitters, the individual conductors of the several cables are generally interconnected through electronic circuit components of one type or another for purposes such as those already mentioned. FIG. 5 is a perspective view of a conventional F-style female connector port 40 that is used on conventional splitters, ground blocks, amplifiers, and the like. FIG. 6 illustrates a conventional coaxial cable splitter 50 having the female connector ports 40 of FIG. 5.

As shown in FIG. 5, the female connector port 40 may comprise a cylindrical housing 41 that has a plurality of external threads 42. The distal face 44 of the cylindrical housing 41 includes an aperture 46. A central conductor 48 (barely visible in FIG. 5) runs longitudinally through the center of the female connector port 40. The internally-threaded nut 38 of a mating male F-style coaxial connector 30 is inserted over, and threaded onto the external threads 42 of the female connector port 40 so that the central conductor 12 of the coaxial cable 10 that is attached to the coaxial connector 30 is received within the aperture 46. The central conductor 48 of female connector port 40 is configured to receive the central conductor 12 of the mating male F-style coaxial connector 30, thereby electrically connecting the central conductors 12, 48. Once the internally-threaded nut 38 is fully threaded onto the external threads 42 of the female connector port 40, the distal face 44 of the female connector port 40 is brought into mechanical and electrical contact with the base 34*b* (FIG. 3) of the contact post 34, thereby providing a ground plane connection between the body assembly 32 of coaxial connector 30 and the housing 41 of the female connector port 40.

When summoned to fix a problem with a cable television subscriber's service, technicians may not take the time to trouble-shoot various connections associated with a drop. Instead, the technicians may cut the F-style coaxial connectors off of the coaxial cables and throw away any splitters, couplers, or other devices. Unfortunately, this practice increases costs to cable television service providers. Moreover, this practice is wasteful in many cases because otherwise good connectors and/or devices are being thrown away.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a "preconnectorized" apparatus (e.g., an RF signal splitter, RF signal amplifier, etc.) includes a housing and a coaxial cable connector extending outwardly from the housing that is configured to be electrically and mechanically attached to a prepared end of a coaxial cable. Apparatus, according to embodiments of the present invention, are "preconnectorized" devices in that coaxial cable connectors are pre-installed at the factory and only require a technician in the field to prepare an end of a coaxial cable and insert the cable end into the connector.

The connector is an F-style coaxial connector having a tubular connector body with a cable receiving end and an opposite forward end, and a compression element coupled to the connector body cable receiving end. The connector includes a tubular inner contact post within the connector body that has an axial bore terminating at an opening in a rearward free end thereof and an opening at a forward end thereof. The contact post free end is configured to be inserted into a prepared coaxial cable end around the center conductor insulation thereof and coaxially beneath the outer conductive layer thereof. The compression element is configured to move between an unseated position and a seated position and is configured to impart a compressive force to secure one or more elements of a coaxial cable within the connector body when the compression element is in the seated position. When in the seated position, the compression element is positioned between the connector body and the contact post. In addition, the compression element is closer to the housing when in the seated position than when in the unseated position.

In some embodiments of the present invention, the compression element is permanently attached to the connector body. In some embodiments of the present invention, an outer surface of the compression element includes a groove therein that is configured to receive a gripping element of a compression tool that is used to move the compression element from the unseated position to the seated position.

In some embodiments of the present invention, the connector body forward end comprises an externally-threaded portion that is threadingly engaged with an internally-threaded housing portion. The connector body is configured to resist rotation once firmly threaded into the internally-threaded housing portion. In other embodiments, the connector body is contained within a port that extends outwardly from the housing. The port has an axial bore that terminates at opposite rearward and forward openings and the connector body is disposed within the axial bore of the port such that the connector body cable receiving end extends outwardly through the port rearward opening.

The connector also includes a receiving member positioned forward of the contact post and electrically connected to a circuit within the housing. The receiving member has an opening in a rearward end thereof that is in communication with the contact post forward end opening. The receiving member is configured to receive a center conductor of a coaxial cable inserted through the connector body cable receiving end and through the contact post axial bore such that the center conductor is electrically connected to the circuit. In some embodiments of the present invention, the connector body forward end includes an opening, and the receiving member extends through the opening and into the housing.

In some embodiments of the present invention, the connector includes an alignment member positioned within the connector body forward end and that coaxially surrounds at least a portion of the receiving member.

According to some embodiments of the present invention, a preconnectorized apparatus (e.g., an RF signal splitter, RF signal amplifier, etc.) includes a housing with first and second connectors extending outwardly from the housing, and wherein the first and second connectors are in electrical communication with each other. Each connector is an F-style coaxial cable connector configured to be electrically and mechanically attached to a prepared end of a coaxial cable. Each connector includes a tubular connector body having a cable receiving end and an opposite forward end, and a compression element coupled to the connector body cable receiving end. Each connector includes a tubular inner contact post within the connector body that has an axial bore terminating at an opening in a rearward free end thereof and an opening at a forward end thereof. The contact post free end of each connector is configured to be inserted into a prepared coaxial cable end around the center conductor insulation thereof and coaxially beneath the outer conductive layer thereof. The compression element of each connector is configured to move between an unseated position and a seated position, and is configured to impart a compressive force to secure one or more elements of a coaxial cable within the connector body when the compression element is in the seated position.

In some embodiments of the present invention, each connector body forward end comprises an externally-threaded portion that is threadingly engaged with a respective internally-threaded housing portion. Each connector body is configured to resist rotation once firmly threaded into the internally-threaded housing portion. In other embodiments, each connector body is contained within a respective port that extends outwardly from the housing. Each port has an axial bore that terminates at opposite rearward and forward openings and each connector body is disposed within the axial bore of the respective port such that the connector body cable receiving end extends outwardly through the port rearward opening.

Each connector also includes a receiving member positioned forward of the contact post and electrically connected to a circuit within the housing. The receiving member has an opening in a rearward end thereof that is in communication with the contact post forward end opening, and the receiving member is configured to receive a center conductor of a coaxial cable inserted through the connector body cable receiving end and through the contact post axial bore such that the center conductor is electrically connected to the circuit. In some embodiments of the present invention, the connector body forward end includes an opening, and the receiving member extends through the opening and into the housing.

According to some embodiments of the present invention, an apparatus for connecting coaxial cables (e.g., an F81 barrel connector, etc.) includes a base having opposite first and second sides, a first F-style connector extending outwardly from the base first side, and a second F-style connector extending outwardly from the base second side. The first and second connectors are in electrical communication with each other, and each connector is configured to be electrically and mechanically attached to a prepared end of a coaxial cable. Each connector is an F-style coaxial cable connector configured to be electrically and mechanically attached to a prepared end of a coaxial cable. Each connector includes a tubular connector body having a cable receiving end and an opposite forward end, and a compression element coupled to the connector body cable receiving end. Each connector includes a tubular inner contact post within the connector body that has an axial bore terminating at an opening in a rearward free end thereof and an opening at a forward end thereof. The contact post free end of each connector is configured to be inserted into a prepared coaxial cable end around the center conductor insulation thereof and coaxially beneath the outer conductive layer thereof. The compression element of each connector is configured to move between an unseated position and a seated position, and is configured to impart a compressive force to secure one or more elements of a coaxial cable within the connector body when the compression element is in the seated position.

According to some embodiments of the present invention, a coaxial cable outer jacket includes connector installation indicia thereon. The connector installation indicia includes at least one pair of first and second spaced-apart indicia. The first indicia indicates a location for applying a cable stripping tool for preparing the coaxial cable for insertion into the connector, and the second indicia indicates a proper depth of insertion of the prepared coaxial cable into the connector. In some embodiments, a plurality of pairs of first and second spaced-apart indicia are on the outer jacket along the length of the cable.

According to some embodiments of the present invention, connector installation indicia includes first, second and third spaced-apart indicia. The first indicia indicates a location for applying a cable stripping tool for preparing the coaxial cable for insertion into a connector. The second indicia indicates a proper depth of insertion of the prepared coaxial cable into a connector. The third indicia indicates proper seating of a connector compression element.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
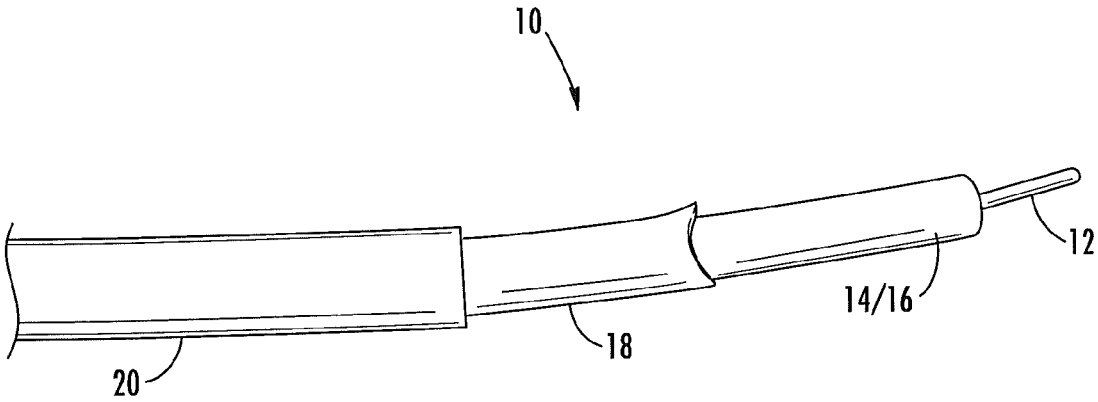
FIG. 1 (PRIOR ART)
FIG. 1 is a perspective view of a conventional coaxial cable that has been partially cut apart.
Figure 2:
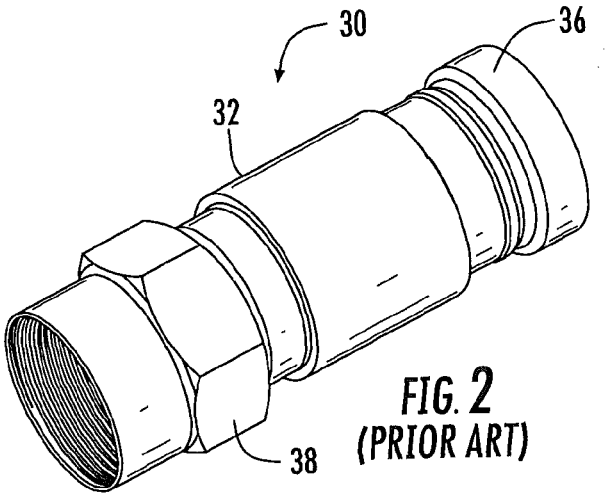
FIG. 2 (PRIOR ART)
FIG. 2 is a perspective view of a conventional male F-style coaxial connector that has a compression style back fitting with the compression sleeve in an unseated position.
Figure 3:
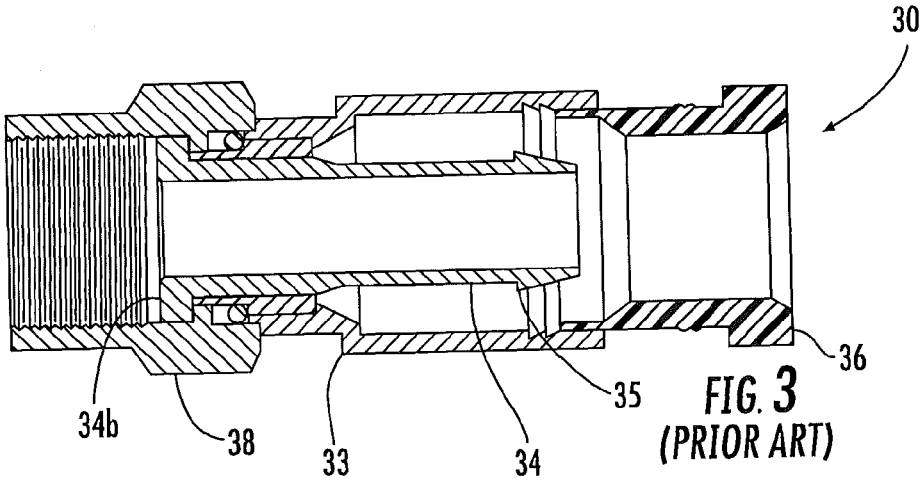
FIG. 3 (PRIOR ART)
FIG. 3 is a side cross-sectional view of the conventional F-style coaxial connector of FIG. 2.
Figure 4:
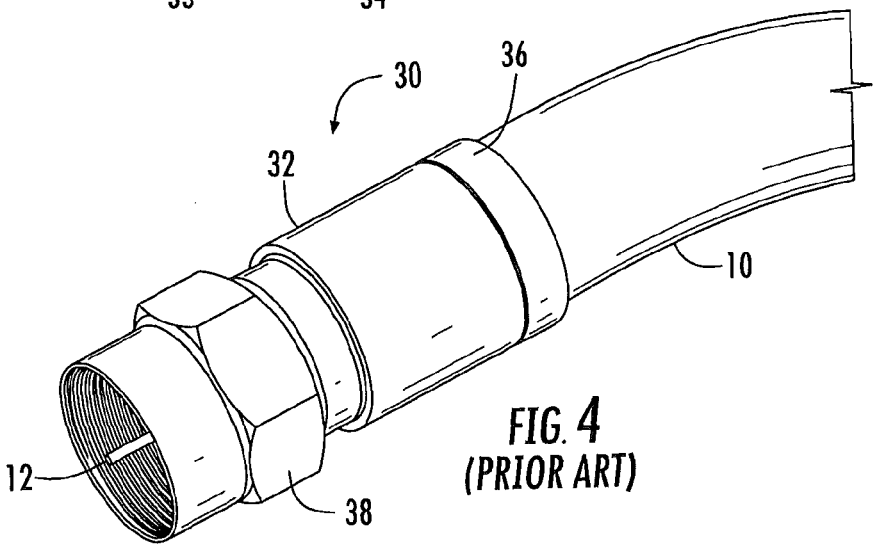
FIG. 4 (PRIOR ART)
FIG. 4 is a perspective view of the conventional F-style coaxial connector of FIG. 2 mounted on a coaxial cable to provide a terminated coaxial cable.
Figure 5:
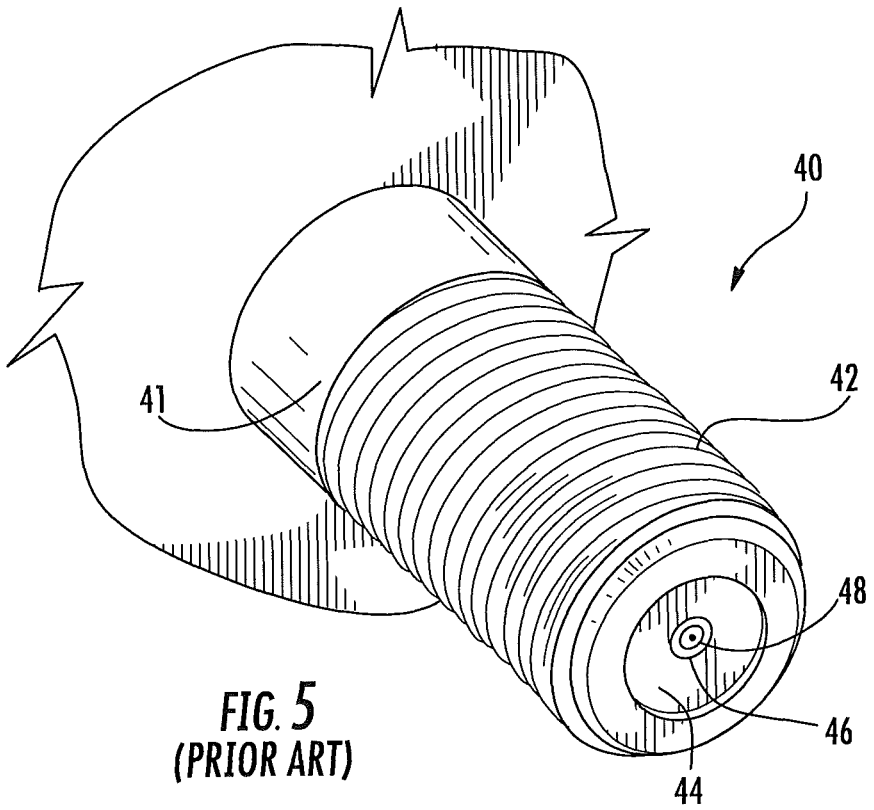
FIG. 5 (PRIOR ART)
FIG. 5 is a perspective view of a conventional female connector port.
Figure 6:
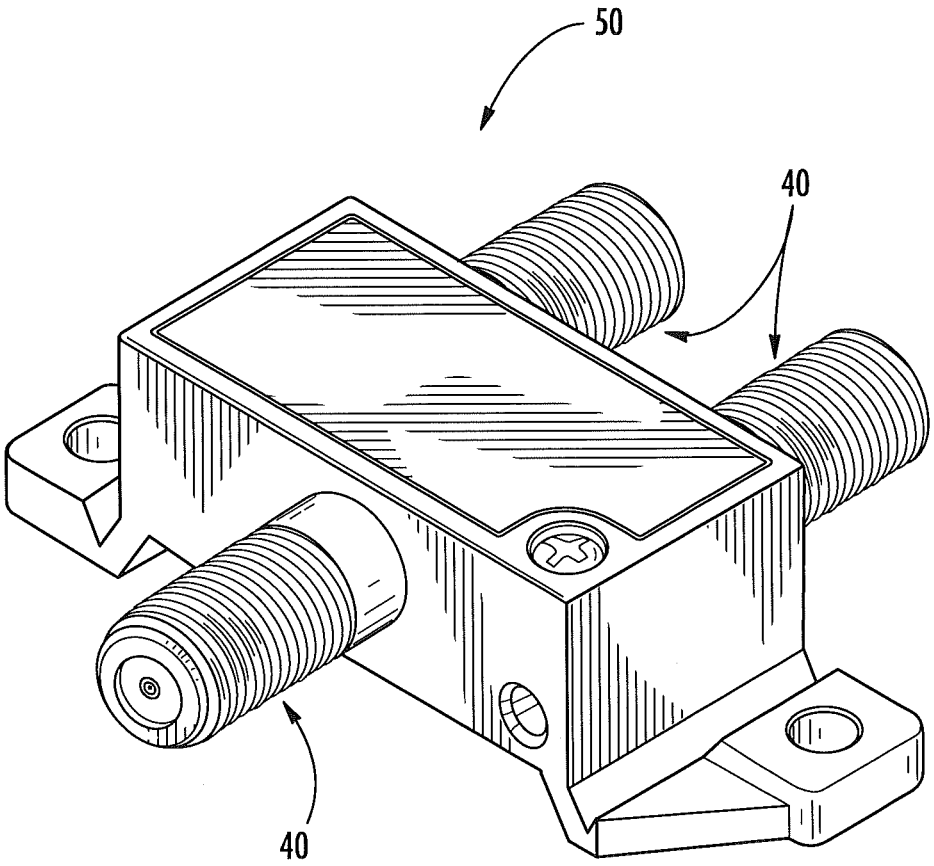
FIG. 6 (PRIOR ART)
FIG. 6 is a perspective view of a conventional coaxial cable splitter that utilizes the female connector port of FIG. 5.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity. In addition, the sequence of operations (or steps) is not limited to the order presented in the claims unless specifically indicated otherwise.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment and/or figure, the features and elements so described or shown can apply to other embodiments and/or figures.

The terminology used herein is for the purpose of describing particular embodiments only and is not intended to be limiting of the invention.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "l". As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Spatially relative terms, such as "under", "below", "lower", "over", "upper" and the like, may be used herein for ease of description to describe one element or feature's relationship to another element(s) or feature(s) as illustrated in the Figures. It will be understood that the spatially relative terms are intended to encompass different orientations of the device in use or operation in addition to the orientation depicted in the Figures. For example, if a device in the Figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

As used herein, the term "longitudinal" and derivatives thereof refer to the direction defined by the central axis of a coaxial connector, which is generally coexistent with the central axis of any coaxial cable that the coaxial connector is installed on when the coaxial cable is fully extended in a straight line. This direction may also be referred to herein as the "axial" direction. The term "transverse" and derivatives thereof refer to the plane that is normal to a longitudinal direction.

It will be understood that although the terms first and second are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Figure 7A:
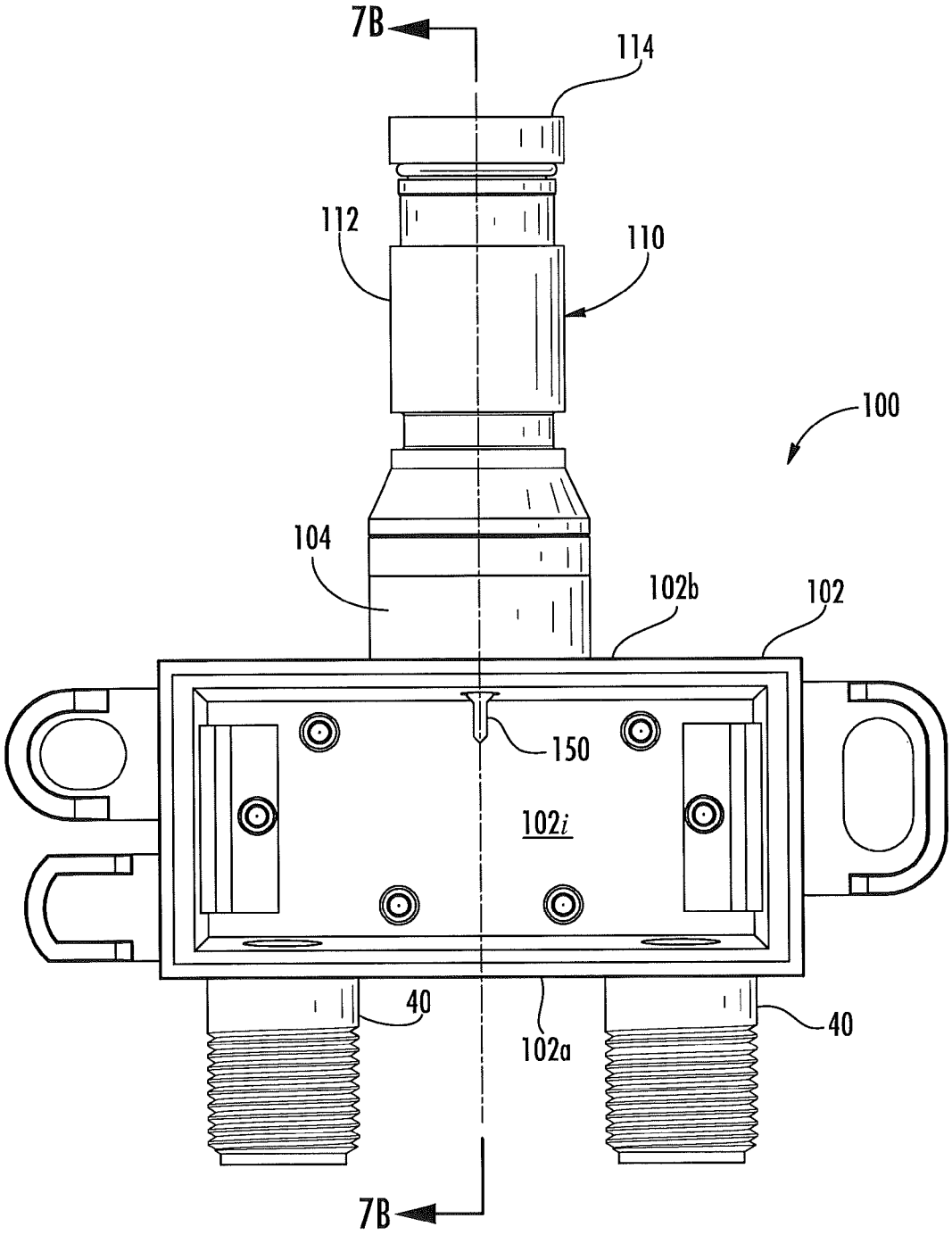
FIG. 7A is a plan view of a "pre-connectorized" apparatus, such as an RF signal splitter or RF signal amplifier, according to some embodiments of the present invention.
Figure 7B:
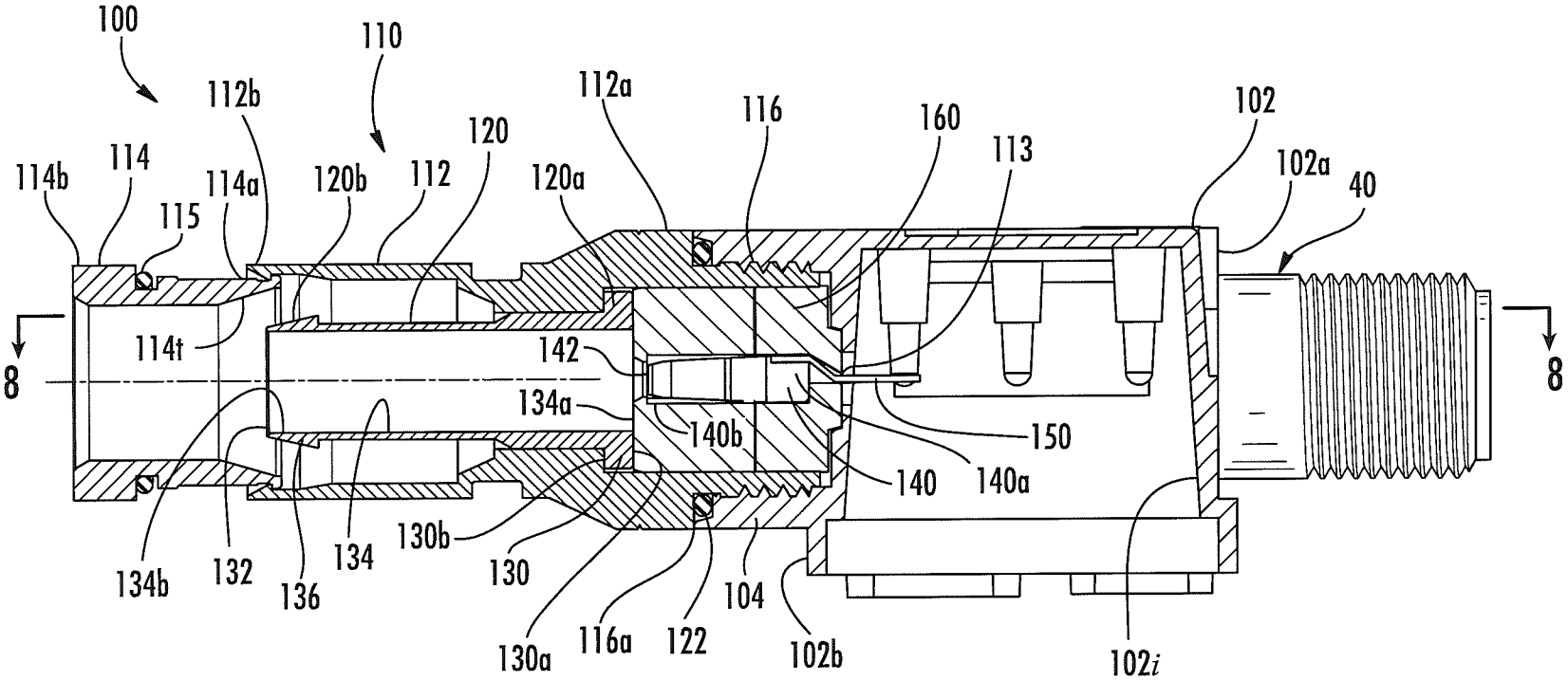
FIG. 7B is a cross-sectional view of the apparatus of FIG. 7A taken along lines 7B-7B.

FIGS. 7A and 7B illustrate a "pre-connectorized" apparatus 100, such as an RF signal splitter or RF signal amplifier, according to some embodiments of the present invention. The term "preconnectorized" means that one or more coaxial cable connectors are pre-installed on the apparatus 100 such that a technician in the field only needs to prepare a coaxial cable end and insert the prepared end into the connector on the apparatus 100 to terminate the coaxial cable into the apparatus 100.

The illustrated apparatus 100 includes a housing 102 with opposite first and second sides 102*a*, 102*b*. A cover is removed from the illustrated housing 102 to illustrate the interior 102*i* thereof. As would be understood by one skilled in the art, circuitry (not shown) is located in the interior 102*i* of the housing 102. This circuitry electrically connects connector 110 with connectors 40 and performs various functions (depending on the type of device) as would be known to one skilled in the art. A pair of conventional female connector ports 40 extend outwardly from the first side 102*a* and an F-style coaxial connector 110 extends outwardly from the second side 102*b*, as illustrated. The connector 110 is configured to be electrically and mechanically attached to a prepared end of a coaxial cable and includes a tubular connector body 112 having a forward end 112*a* (FIG. 7B) and an opposite cable receiving end 112*b* (FIG. 7B). The connector 110 also includes a compression element 114 coupled to the connector body cable receiving end 112*b*. The compression element 114 is configured to move between an unseated position and a seated position. The compression element 114 is configured to impart a compressive force to secure one or more elements of a coaxial cable within the connector body 112 when the compression element 114 is in the seated position.

The illustrated connector body forward end 112*a* includes an externally-threaded end portion 116 (FIG. 7B) that is threadingly engaged with an internally-threaded portion 104 of the housing 102 that extends outwardly from the housing second side 102*b*. The connector body 112 is configured to resist rotation once the end portion 116 is firmly threaded into the internally-threaded housing portion 104. The illustrated connector body 112 has a generally cylindrical configuration and does not include a hexagonal portion that can be engaged by a wrench. In some embodiments, a substance may be applied to the threads of the externally-threaded end portion 116 and/or the internally-threaded portion 104 that inhibits rotation thereof. An exemplary substance is LOCTITE® brand threadlocker (Henkel Corporation, Westlake, OH.). In some embodiments, a pin or other such member may be utilized to prevent rotation, as would be understood by one skilled in the art.

The connector body 112 including the externally-threaded end portion 116 may be formed of a conductive metal such as, for example, brass, steel, or bronze, or alloys thereof or another metal or metal alloy. In some embodiments, the connector body 112 may be formed of a non-conductive material such as plastic. The inner and/or outer diameters of the connector body 112 may vary along the length of the connector body 112.

The externally-threaded end portion 116 further includes an external annular ridge 116*a*. An O-ring, gasket or other member 122 may be positioned around the externally-threaded end portion 116 adjacent the annular ridge 116*a*, as illustrated in FIG. 7B. When the externally-threaded end portion 116 threadingly engages the internally-threaded housing portion 104, the O-ring 122 engages the annular end portion of the housing portion 104 to reduce or prevent water or moisture ingress into the interior of the F-style connector 110 and apparatus 100.

The connector 110 includes a tubular inner contact post 120 within the connector body 112 (FIG. 7B). The contact post 120 has an axial bore 134 that terminates at an opening 134*a* at the forward end 120*a* thereof, and an opening 134*b* in the rearward free end 120*b* thereof. The contact post free end 120*b* is configured to be inserted into a prepared coaxial cable end around the center conductor insulation thereof and coaxially beneath the outer conductive layer thereof. The outside surface of the free end 120*b* of the contact post 120 may include one or more serrations, teeth, lips or other structures 136. The contact post 120 is typically formed of a conductive material such as, for example, brass, steel, or bronze, or alloys thereof.

The compression element 114 may comprise a hollow cylindrical body having a front end 114*a* and a rear end 114*b* and may be permanently attached to the connector body 112. The compression element 114 is typically formed of a non-conductive, plastic material, but may also be formed of other materials. In some embodiments, the front end 114*a* of the compression element 114 may have a first external diameter that is less than a second external diameter of the rear end 114*b* of the compression element 114. A gasket or O-ring 115 is mounted on the exterior surface of the compression element 114. As shown in FIG. 7B, the inner diameter of the front end 114*a* of the compression element 114 may be greater than the inner diameter of the rear end 114*b* of the compression element 114. A ramped transition section 114*t* may connect the inner radii of the front and rear ends 114*a*, 114*b* of the compression element 114.

The compression element 114 is closer to the apparatus housing 102 when in the seated position than when in the unseated position. In addition, the compression element 114 is positioned between the connector body 112 and the contact post 120 when in the seated position. The outer surface of the compression element 114 may include a groove therein (not shown) that is configured to receive a gripping element of a compression tool that is used to move the compression element 114 from the unseated position to the seated position.

Still referring to FIG. 7B, the connector 110 includes a receiving member 140 that is positioned forward of the contact post 120 and that is electrically connected to circuitry (not shown) within the housing interior 102*i*. In the illustrated embodiment, the receiving member 140 is electrically connected to the circuit via a conductive element 150 that extends into the housing 102. The illustrated receiving member 140 has an opening 142 in a rearward end 140*b* thereof that is in communication with the contact post forward end opening 134*a*. The receiving member 140 is configured to receive and make electrical contact with a center conductor 12 of a coaxial cable 10 that is inserted through the connector body cable receiving end 112*b* and through the contact post axial bore 134. When received in the receiving member 140, the center conductor 12 is electrically connected to the circuit via the receiving member 140 and conductive element 150. In the illustrated embodiment, the receiving member 140 extends through an opening 113 in the connector body forward end 112*a* and into the housing 102.

The receiving member 140 and conductive element 150 may each have various shapes and configurations. The receiving member 140 and conductive element 150 may each be formed of a conductive metal such as, for example, brass, steel or bronze or alloys thereof or another metal or metal alloy. In the illustrated embodiment, an alignment member 160 is positioned within the connector body forward end 112*a* and coaxially surrounds at least a portion of the receiving member 140. The alignment member 160 is configured to retain the receiving member 140 in place and properly aligned with the axial bore 134 of the contact post 120 such that a center conductor of a coaxial cable can be positioned within the receiving member 140 without interference and with minimal effort by a technician.

Figure 8:
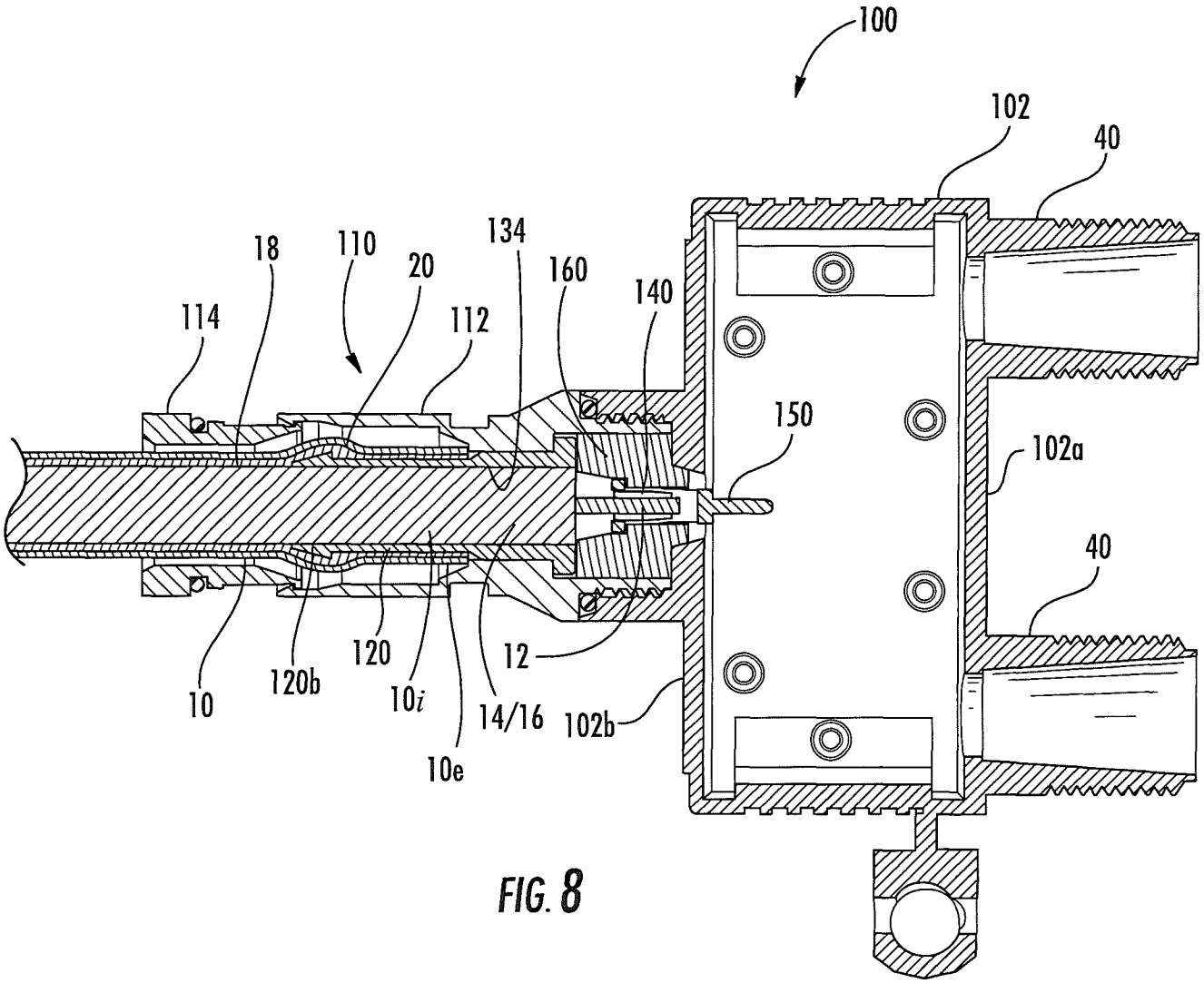
FIG. 8 is a cross-sectional view of the apparatus of FIG. 7B taken along lines 8-8, and illustrating a coaxial cable electrically and mechanically secured within a connector thereof.

FIG. 8 is a section view of the apparatus 100 of FIGS. 7A-7B illustrating the connector 110 terminating an end of a coaxial cable 10. Before the cable 10 is inserted into the connector 110, end portions of the dielectric 14, the tape 16, the electrical shield 18 and the cable jacket 20 are cut off and removed so that the end portion of the central conductor 12 is fully exposed, as described above with respect to FIG. 1. Additional end portions of the cable jacket 20 and any electrical shielding tape are then removed to expose the end portion of the wires of the electrical shield 18. The central conductor 12, dielectric 14, and the tape 16 of cable 10 are axially inserted through the compression element 114 and into the axial bore 134 of the contact post 120, while the electrical shield 18 and the cable jacket 20 are inserted through the compression element 114 and over the outside surface of the contact post 120. The exposed length of the central conductor 12 is sufficient such that it will pass all the way through the connector body 118 and extend into the receiving member 140. The exposed end portions of the wires of the electrical shield 18 reside in a front portion of the generally annular cavity between the contact post 120 and the connector body 112, thereby placing the electrical shield 18 in mechanical and electrical contact with at least one of the connector body 118 or the contact post 120. The center conductor 12 of the coaxial cable 10 is electrically connected to a circuit within the housing 102 via the conductive element 150. An installer then uses a compression tool to move the compression element 114 into its seated position after the coaxial cable has been inserted into the connector body to lock the coaxial cable in place.

Figure 9:
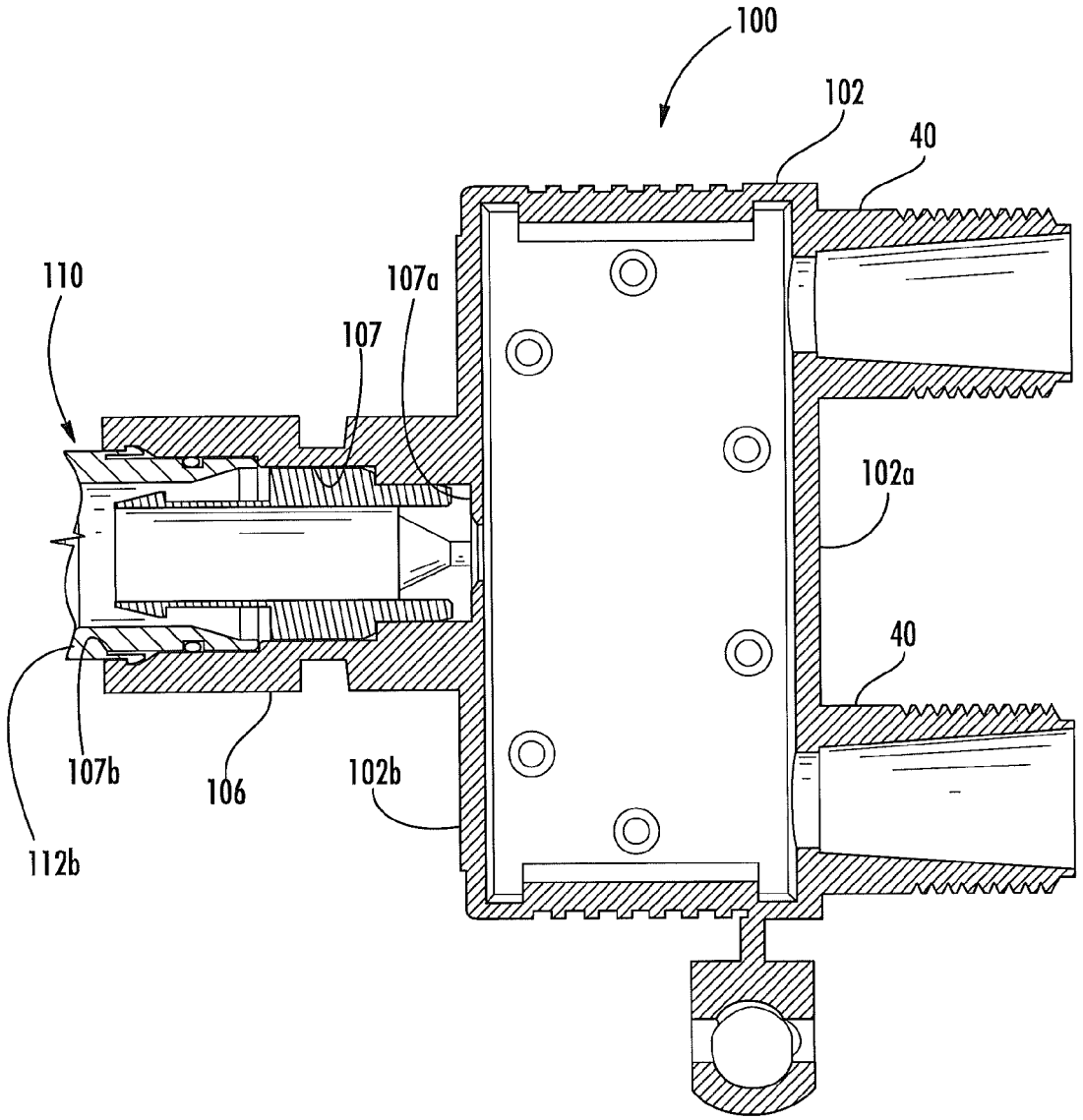
FIG. 9 is a cross-sectional view of a "pre-connectorized" apparatus, such as an RF signal splitter or RF signal amplifier, according to other embodiments of the present invention.

Referring to FIG. 9, a "pre-connectorized" apparatus 100, such as an RF signal splitter or RF signal amplifier, according to other embodiments of the present invention is illustrated. The illustrated apparatus 100 includes a housing 102 with opposite first and second sides 102*a*, 102*b*. A pair of female connector ports 40 extend outwardly from the first side 102*a* and an F-style coaxial connector 110 similar to the connector 110 of FIGS. 7A-7B and 8 extends outwardly from the second side 102*b*, as illustrated. However, the connector 110 is not threadingly secured to the housing. Instead, the connector 110 is contained within a port 106 that extends outwardly from the housing 102. The outwardly extending port 106 has an axial bore 107 that terminates at opposite forward and rearward openings 107*a*, 107*b*. The connector body 112 is disposed within the axial bore 107 of the port 106 such that the connector body cable receiving end 112*b* extends outwardly through the port rearward opening 107*b*. Although not illustrated, the connector 110 in FIG. 9 also includes a compression element as described above.

In the embodiment illustrated in FIG. 9, the connector 110 is assembled within the port during manufacturing of the apparatus 100. For example, the housing 102 may comprise two matable sections and the connector 110 is assembled within the port 106 as the two sections are secured together, for example, via fasteners (e.g., bolts, screws, rivets, etc.), during manufacturing. However, the connector 110 may be secured within the port 106 in various ways, without limitation.

In each of the embodiments illustrated in FIGS. 7A-7B, 8, and 9, one or both of the illustrated female ports 40 may be replaced with an F-style coaxial connector. FIGS. 7A-7B, 8 and 9 only show one F-style coaxial connector 110 for ease of illustration.

Figure 10A:
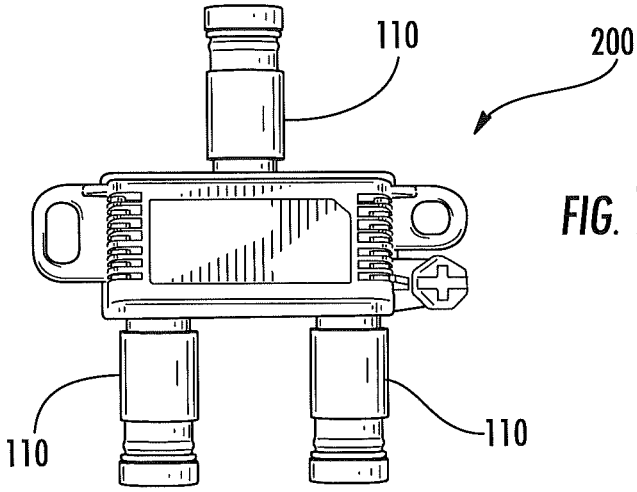
FIGS. 10A-10C are plan views of "pre-connectorized" RF signal splitter devices, according to some embodiments of the present invention.
Figure 10B:
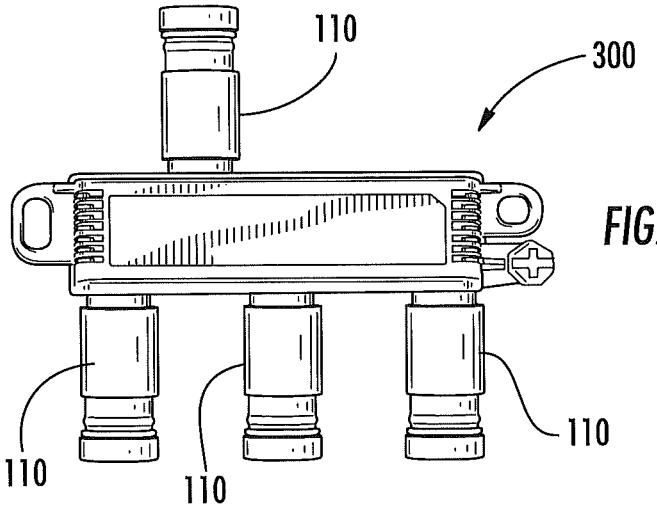
Figure 10C:
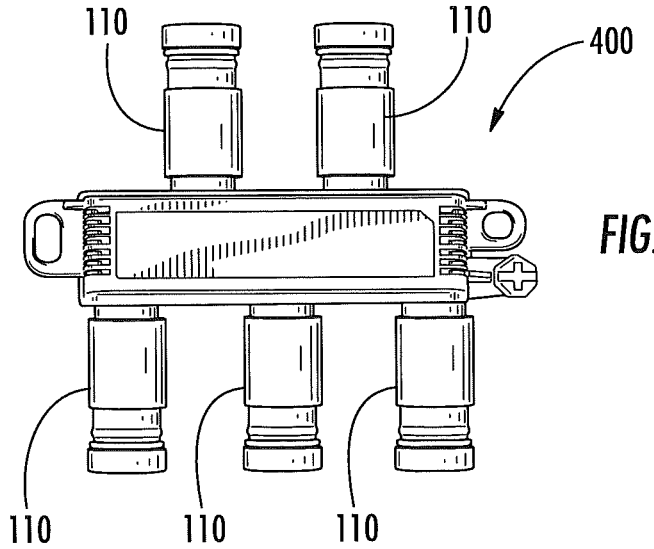
Figure 11:
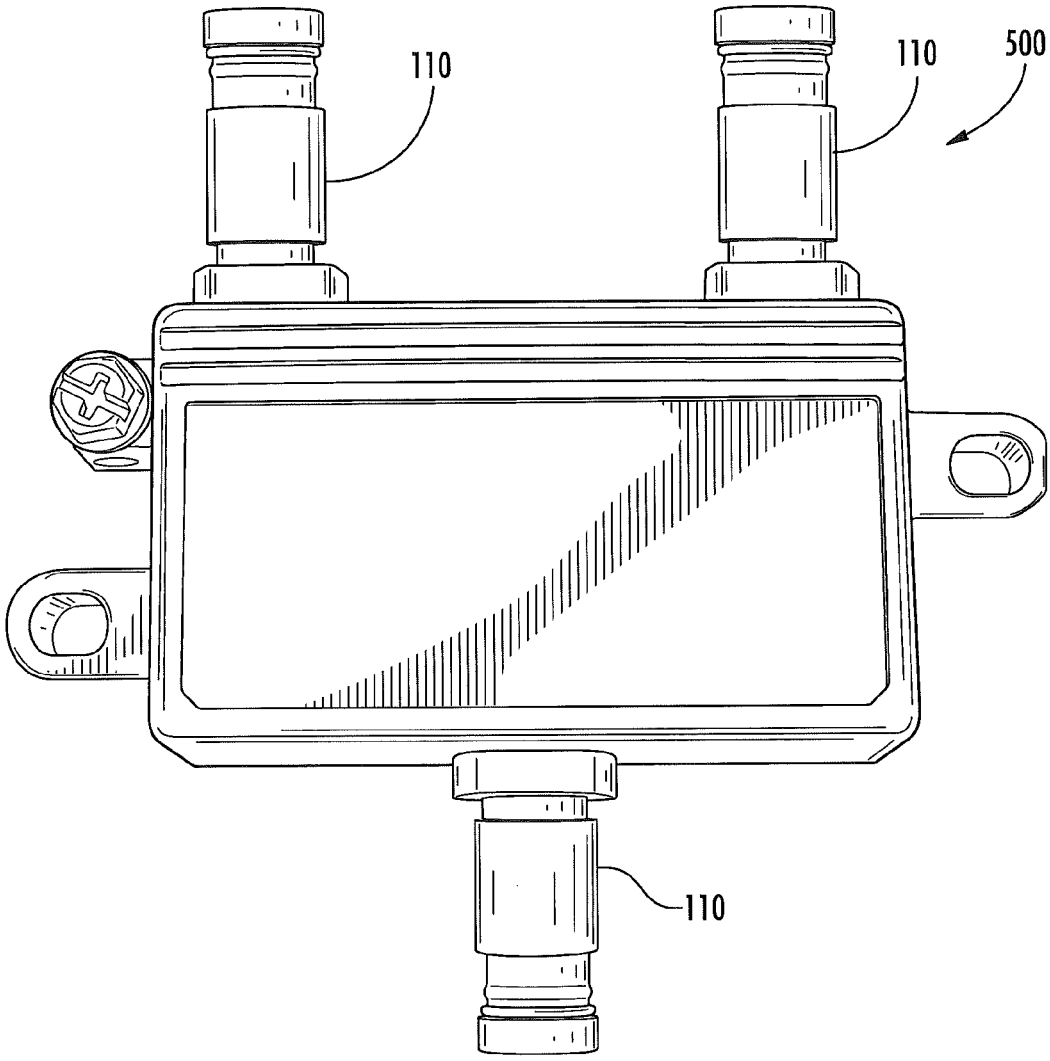
FIG. 11 is a plan view of a "pre-connectorized" RF signal amplifier apparatus, according to some embodiments of the present invention.

FIGS. 10A-10C illustrate "pre-connectorized" RF signal splitter apparatuses that include F-style coaxial connectors 110 as described above, according to some embodiments of the present invention. FIG. 10A illustrates a 2:1 RF signal splitter apparatus 200, FIG. 10B illustrates a 3:1 RF signal splitter apparatus 300, and FIG. 100 illustrates a 4:1 RF signal splitter apparatus 400. FIG. 11 illustrates a "pre-connectorized" RF signal amplifier apparatus 500 that includes F-style coaxial connectors 110 as described above, according to some embodiments of the present invention.

Figure 12:
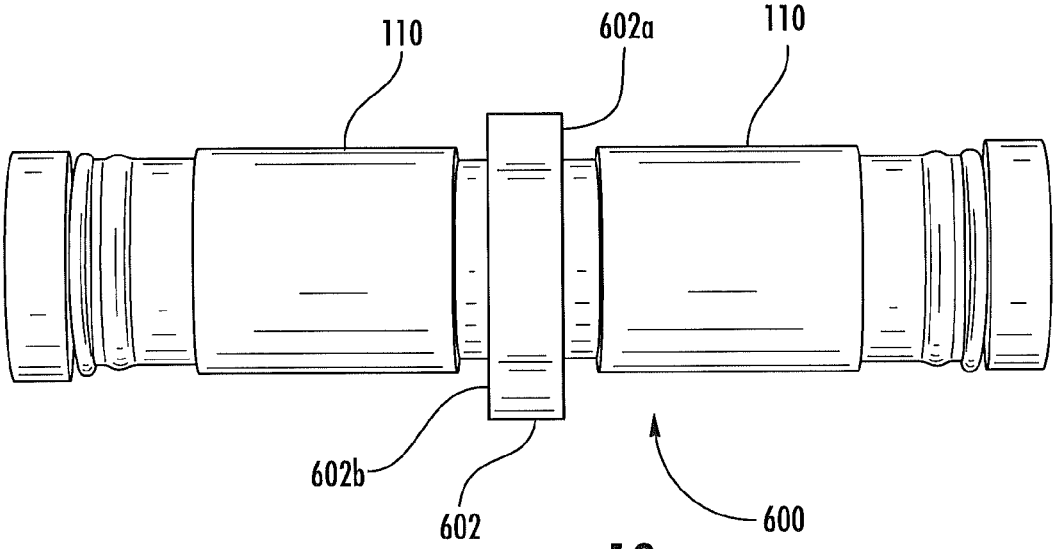
FIG. 12 is a plan view of a "pre-connectorized" barrel connector apparatus, according to some embodiments of the present invention.

FIG. 12 illustrates a "pre-connectorized" barrel connector apparatus 600 (also referred to as an "F81" connector) that includes F-style coaxial connectors 110 as described above, according to some embodiments of the present invention. The illustrated barrel connector apparatus 600 includes a base 602 having opposite first and second sides 602*a*, 602*b*. A respective connector 110 extends outwardly from the first and second sides 602*a*, 602*b* of the base 602, as illustrated. The two connectors 110 are in electrical communication with each other and function like connector 110 of FIGS. 7A, 7B and 8.

Figure 13:
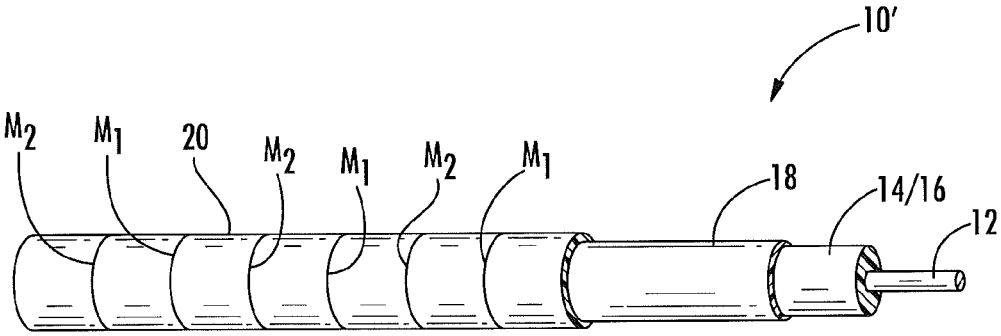
FIG. 13 is a partial perspective view of a coaxial cable having connector installation indicia on the outer jacket thereof, according to some embodiments of the present invention.

Referring now to FIG. 13, according to some embodiments of the present invention, the outer jacket of a coaxial cable 10' includes connector installation indicia to facilitate preparing the coaxial cable for insertion into a connector 110 and for ensuring that the coaxial cable 10' is properly connected to the connector 110. The connector installation indicia is located at regular intervals along the length of the cable 10'. In the illustrated embodiment of FIG. 13, the connector installation indicia includes a plurality of pairs of first and second spaced-apart indicia $M_1$, $M_2$. The first indicia $M_1$ indicates a location for applying a cable stripping tool for preparing the coaxial cable 10' for insertion into a connector 110. The second indicia $M_2$ indicates a proper depth of insertion of the prepared coaxial cable 10' into the connector 110. The second indicia $M_2$ allows a technician to visually see when a connector 110 is on the cable 10' correctly.

Figure 14:
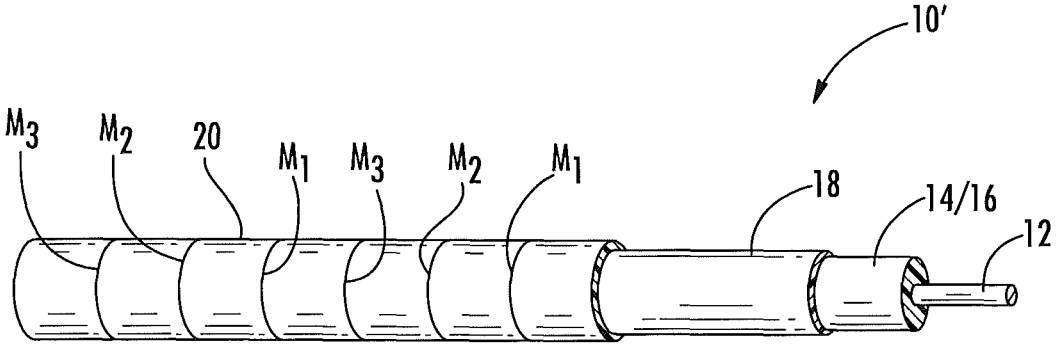
FIG. 14 is a partial perspective view of a coaxial cable having connector installation indicia on the outer jacket thereof, according to some embodiments of the present invention.

Referring to FIG. 14, in other embodiments, an additional third indicia $M_3$ may be utilized to indicate when the compression connecter fitting 114 is seated correctly after insertion of the prepared cable end into a connector 110.

Connector installation indicia may be applied to the outer jacket 20 of a coaxial cable via printing or other known methods. In some embodiments of the present invention, the connector installation indicia may be formed in the outer jacket 20 of a coaxial cable during extrusion of the outer jacket 20. In other embodiments of the present invention, the connector installation indicia may be adhesively secured to the outer jacket 20 of a coaxial cable. Connector installation indicia, according to embodiments of the present invention, may include all types of markings including, but not limited to, lines, text, lettering (i.e., alphabetical characters, alphanumeric characters), designs, characters, logos, images, graphics, symbols, etc.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An apparatus, comprising:

a housing; and an F-style coaxial connector extending outwardly from the housing, the connector configured to be electrically and mechanically attached to a prepared end of a coaxial cable, the connector comprising:

a tubular connector body having a cable receiving end and an opposite forward end;

a tubular inner contact post within the connector body, wherein the contact post has an axial bore terminating at an opening in a rearward free end thereof and an opening at a forward end thereof, wherein the contact post free end is configured to be inserted into a prepared coaxial cable end around a center conductor insulation thereof and coaxially beneath an outer conductive layer thereof;

a receiving member positioned forward of the contact post and electrically connected to a circuit within the housing, wherein the receiving member has an opening in a rearward end thereof that is in communication with the contact post forward end opening, and wherein the receiving member is configured to receive a center conductor of the prepared coaxial cable inserted through the connector body cable receiving end and through the contact post axial bore such that the center conductor is electrically connected to the circuit; and a compression element coupled to the connector body cable receiving end, the compression element configured to move between an unseated position and a seated position, wherein the compression element is configured to impart a compressive force to secure one or more elements of a coaxial cable within the connector body when the compression element is in the seated position.

2. The apparatus of claim 1, wherein the housing comprises an internally-threaded portion, wherein the connector body forward end comprises an externally-threaded portion that is threadingly engaged with the internally-threaded housing portion, and wherein the connector body is configured to resist rotation once firmly threaded into the internally-threaded housing portion.

3. The apparatus of claim 1, further comprising an alignment member positioned within the connector body forward end and that coaxially surrounds at least a portion of the receiving member.

4. The apparatus of claim 1, wherein the connector body forward end comprises an opening, and wherein the receiving member extends through the opening and into the housing.

5. The apparatus of claim 1, wherein the compression element is permanently attached to the connector body.

6. The apparatus of claim 1, wherein the apparatus comprises an RF signal splitter apparatus or an RF signal amplifier apparatus.

7. An apparatus, comprising:

a housing that comprises an outwardly extending port having an axial bore that terminates at opposite rearward and forward openings; and a connector extending outwardly from the housing, the connector configured to be electrically and mechanically attached to a prepared end of a coaxial cable, the connector comprising:

a tubular connector body having a cable receiving end and an opposite forward end, wherein the connector body is non-threadingly secured within the axial bore of the port such that the connector body cable receiving end extends outwardly through the port rearward opening; and a compression element coupled to the connector body cable receiving end, the compression element configured to move between an unseated position and a seated position, wherein the compression element is configured to impart a compressive force to secure one or more elements of a coaxial cable within the connector body when the compression element is in the seated position.

8. The apparatus of claim 7, wherein the connector comprises an F-style coaxial connector having a tubular inner contact post within the connector body, wherein the contact post has an axial bore terminating at an opening in a rearward free end thereof and an opening at a forward end thereof, wherein the contact post free end is configured to be inserted into a prepared coaxial cable end around the center conductor insulation thereof and coaxially beneath the outer conductive layer thereof.

9. The apparatus of claim 8, further comprising a receiving member positioned forward of the contact post and electrically connected to a circuit within the housing, wherein the receiving member has an opening in a rearward end thereof that is in communication with the contact post forward end opening, and wherein the receiving member is configured to receive a center conductor of a coaxial cable inserted through the connector body cable receiving end and through the contact post axial bore such that the center conductor is electrically connected to the circuit.

10. The apparatus of claim 9, further comprising an alignment member positioned within the connector body forward end and that coaxially surrounds at least a portion of the receiving member.

11. The apparatus of claim 9, wherein the connector body forward end comprises an opening, and wherein the receiving member extends through the opening and into the housing.

12. An apparatus, comprising:

a housing; and first and second connectors extending outwardly from the housing, wherein the first and second connectors are in electrical communication with each other;

wherein each connector is configured to be electrically and mechanically attached to a prepared end of a coaxial cable, and wherein each connector comprises:

a tubular connector body having a cable receiving end and an opposite forward end;

a tubular inner contact post within the connector body, wherein the contact post has an axial bore terminating at an opening in a rearward free end thereof and an opening at a forward end thereof, wherein the contact post free end is configured to be inserted into a prepared coaxial cable end around a center conductor insulation thereof and coaxially beneath an outer conductive layer thereof;

a receiving member positioned forward of the contact post and electrically connected to a circuit within the housing, wherein the receiving member has an opening in a rearward end thereof that is in communication with the contact post forward end opening, and wherein the receiving member is configured to receive a center conductor of the prepared coaxial cable inserted through the connector body cable receiving end and through the contact post axial bore such that the center conductor is electrically connected to the circuit; and a compression element coupled to the connector body cable receiving end, the compression element configured to move between an unseated position and a seated position, wherein the compression element is configured to impart a compressive force to secure one or more elements of a coaxial cable within the connector body when the compression element is in the seated position.

13. An apparatus, comprising:

a base having opposite first and second sides;

a first connector extending outwardly from the base first side; and a second connector extending outwardly from the base second side;

wherein the first and second connectors are in electrical communication with each other;

wherein each connector is configured to be electrically and mechanically attached to a prepared end of a coaxial cable, and wherein each connector comprises:

a tubular connector body having a cable receiving end and an opposite forward end;

a tubular inner contact post within the connector body, wherein the contact post has an axial bore terminating at an opening in a rearward free end thereof and an opening at a forward end thereof, wherein the contact post free end is configured to be inserted into a prepared coaxial cable end around a center conductor insulation thereof and coaxially beneath an outer conductive layer thereof;

a receiving member positioned forward of the contact post and electrically connected to a circuit within the housing, wherein the receiving member has an opening in a rearward end thereof that is in communication with the contact post forward end opening, and wherein the receiving member is configured to receive a center conductor of the prepared coaxial cable inserted through the connector body cable receiving end and through the contact post axial bore such that the center conductor is electrically connected to the circuit; and a compression element coupled to the connector body cable receiving end, the compression element configured to move between an unseated position and a seated position, wherein the compression element is configured to impart a compressive force to secure one or more elements of a coaxial cable within the connector body when the compression element is in the seated position.

* * * * *